US007624796B2

(12) United States Patent
Hassel-Sorensen

(10) Patent No.: US 7,624,796 B2
(45) Date of Patent: Dec. 1, 2009

(54) ARRANGEMENT OF TEST PLUG

(75) Inventor: Tore Hassel-Sorensen, Bergen (NO)

(73) Assignee: TC Plug Technology AS, Bergen (NO)

( * ) Notice: Subject to any disclaimer, the term of this patent is extended or adjusted under 35 U.S.C. 154(b) by 389 days.

(21) Appl. No.: 10/545,667

(22) PCT Filed: Feb. 16, 2004

(86) PCT No.: PCT/NO2004/000045

§ 371 (c)(1),
(2), (4) Date: Jun. 26, 2006

(87) PCT Pub. No.: WO2004/072438

PCT Pub. Date: Aug. 26, 2004

(65) Prior Publication Data

US 2007/0012438 A1 Jan. 18, 2007

(30) Foreign Application Priority Data

Feb. 14, 2003 (NO) ..... 20030734

(51) Int. Cl.
*E21B 33/12* (2006.01)

(52) U.S. Cl. ..... 166/192; 166/203; 166/250.08; 166/386

(58) Field of Classification Search ..... 166/386, 166/387, 114, 191, 192, 203, 250.08; 138/89, 138/90

See application file for complete search history.

(56) References Cited

U.S. PATENT DOCUMENTS 3,371,521 A * 3/1968 Hauk ..... 73/46
3,490,525 A * 1/1970 Nettles ..... 166/97.1
4,194,389 A * 3/1980 Laging ..... 73/46
4,862,961 A 9/1989 Neff
5,100,259 A 3/1992 Buelt et al.
5,398,763 A 3/1995 Watson et al.

(Continued)

FOREIGN PATENT DOCUMENTS

WO WO 01/77484 10/2001

OTHER PUBLICATIONS

International Search Report for International Appl. No. PCT/NO2004/000045, Feb. 16, 2004, TC Plug Technology As et al., 3 pages.

International Preliminary Report on Patentability for International Appl. No. PCT/NO2004/000045, providing the Written Opinion of the International Search Authority, International Search Authority, Stockholm, Sweden, mailed on Jun. 21, 2004, 5 pages.

*Primary Examiner*—David J Bagnell
*Assistant Examiner*—Robert E Fuller
(74) *Attorney, Agent, or Firm*—Sterne, Kessler, Goldstein & Fox P.L.L.C.

(57) ABSTRACT

An arrangement is described of a plug with a sealing system for pressure testing of bore holes and the like in a formation or the like, comprising a pipe in which the plug is fitted in a plug-carrying chamber, and the plug closes the passage through the pipe in cooperation with sealing bodies, as the plug is arranged (rests) in a seat in the chamber. The arrangement is characterised in that the sealing bodies (23,25) are arranged in connection with the inner wall of the pipe (10) above (upstream) and/or below (downstream) of the chamber (30), and are arranged to form a seal against the respective cylindrical extensions (44,46) of the plug body (45) above and/or below the chamber.

16 Claims, 4 Drawing Sheets

U.S. PATENT DOCUMENTS

| | | | |
|---|---|---|---|
| 5,607,017 | A | 3/1997 | Owens et al. |
| 5,623,993 | A | 4/1997 | Van Buskirk et al. |
| 5,924,696 | A | 7/1999 | Frazier |
| 6,474,414 | B1 | 11/2002 | Gonzalez et al. |
| 6,923,263 | B2 | 8/2005 | Eden et al. |
| 7,210,533 | B2 | 5/2007 | Starr et al. |
| 2003/0000710 | A1 | 1/2003 | Turley et al. |
| 2007/0163776 | A1 * | 7/2007 | Sorensen ..... 166/179 |

* cited by examiner

ARRANGEMENT OF TEST PLUG

The present invention relates to an arrangement of a test plug as described in the introduction to the subsequent independent claim. Furthermore, the invention relates to a new construction for removal of such test plugs.

It is well known that a production well for oil must be tested before it is put into use. One of these tests concerns ensuring that it withstands the pressure at which it shall be operating during the oil/gas production. If not, there is a risk that fluids will leak out of the well.

For conducting such tests a plug which shuts off the passage is placed down into the well. By applying a pressure from the surface with the help of a suitable fluid one can over time-period establish that the well is sufficiently leak-proof. Previously, one used plugs which were pulled up after use. Lately, one wishes to use plugs that do not have to be pulled up again afterwards. That means plugs which are either crushed or dissolved after use.

In practice, the plug is fitted in the form of a so-called TDP (Tubing Disappearing Plug) as the lowest part of the tubing/production pipe and is lowered internally in a lining pipe, also called a "casing" which is fitted into the well in advance.

Test plugs are placed in a special suitable seat in the tubing/pipe, and gasket systems in the form of standard O-rings are used to achieve a sufficient seal against the surrounding inner wall of the pipe. The O-rings are placed in an adapted cut out in the inner pipe wall and seal against the plug that lies radially inside, resting in its seat.

To use ceramics or glass as material in such plugs is well known, as is shown, for example, in Norwegian Patent Application 2000 1801 belonging to the applicant. In general, glass is very appropriate as plug material for the oil industry. It is almost inert to all types of chemicals and it is safe for the personnel that shall handle the plug. Furthermore, glass retains its strength at high temperatures, and it can remain in an oil well for a very long time without being damaged or disintegrate. In general, the producers have gained much knowledge about glass materials over the years.

It is known that under extreme pressure standard O-rings can damage the glass. This is because the O-ring is forced/extruded out past the O-ring groove and damages the glass when the surface pressure is too high, by scratches and minute fissures arising in the glass.

It is known that ceramic/glass plugs (TDP) comprise an explosive charge, which is detonated when the test is completed so that the plug is crushed and the passage opens up for free through-flow. The advantage with such crushing is that the ceramic material or the glass is crushed to small particles that are simply flushed out of the well without leaving residues that can be harmful. Such explosive charges have normally been incorporated into the plug itself, in that one or more cut outs/holes for placing of the explosive charge have been drilled out from the top of the plug. However, this leads to a weakening of the plug structure, as scratches and fissures formations can easily arise in the glass when it is exposed to high pressures or pressure variations during the preparatory tests.

At the same time, the industry wants to be able to use higher working pressures in the production wells. This places even more stringent demands on the performance ability of the test plug, i.e. the forces it must be able to withstand, as these forces can gradually become so great that the contact area becomes too small, and one thereby risks that the glass is crushed against the contact face.

It has been found that the shape of the seat, and thereby the plug face that shall rest against the seat, can have a large influence on which pressures the plug can withstand.

Solutions where whole or part of the plug is manufactured from rubber are also previously known, and where a section comprises a chemical that dissolves the rubber plug when the test is completed and one wishes to remove the plug. However, this method will be far too unsafe and slow in operation from floating rigs, viewed in the light of the operating costs for such a platform. Here one must know exactly the time when the plug is removed and the passage is opened.

On the basis of the above, it is an aim of the invention to provide a new plug construction that overcomes the above mentioned disadvantages, i.e. a construction that can withstand higher pressures during the test procedures.

It is a further aim of the invention to provide a new construction for a plug that can offer an improved sealing function, and that can withstand much higher pressure loads that previously.

It is a further aim to provide a new construction for placing of an explosive charge in connection with a plug.

The construction of the plug according to the invention is characterised by the features that are given by the characteristics in the subsequent claim 1.

The construction of the detonating system in connection with the plug construction is characterised by the features that are given in the subsequent claims.

The construction of the gasket system in connection with the plug construction, and provision of pressure distribution, is characterised by the features that are given in the dependent claims.

When using the plug, first and second mutually spaced apart sealing rings are used so that the pressure can be distributed between the first sealing ring and the one or more additional sealing rings.

The preferred embodiments of the above mentioned inventions are given in the dependent claims.

The invention shall now be explained in more detail with reference to the subsequent figures, in which.

Figure 1:
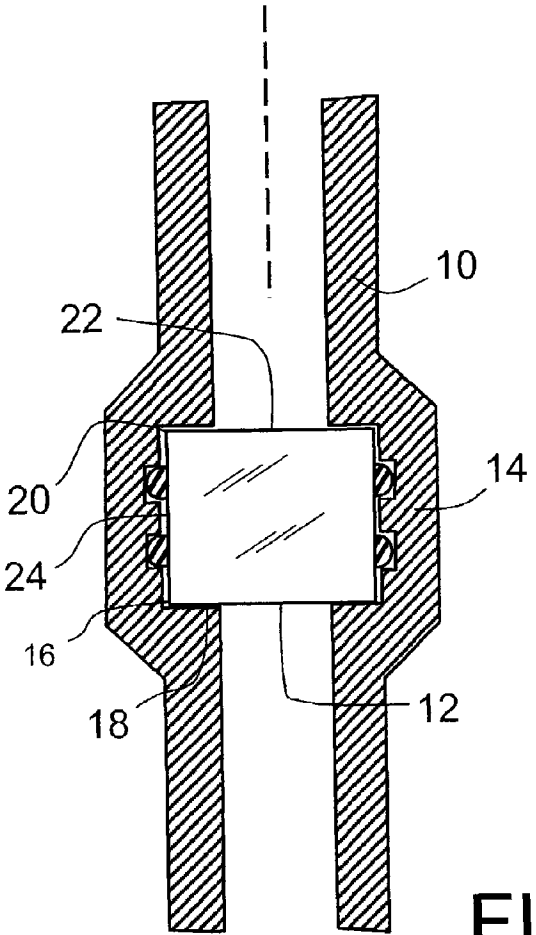
FIG. 1 Prior Art

FIG. 1 shows a tubing or production pipe 10 of the previously known type, and in which a plug 12 is fitted. The plug 12 is placed in an enlarged section 14 of the pipe 10, said section 14 has a slightly larger diameter that the rest of the pipe to make room for the plug. The plug 12, which has the shape of a cylindrical body, rests with its underside 16 against a ring-formed shoulder-like seat 18 at the bottom of the enlarged section. A "sharp" edge 20 forms the transition between the upper side 22 and the side face 24 of the plug. The face of the seat 18 forms a right angle with the longitudinal axis X of the pipe 10. The first and second gasket rings (O-rings) 23 and 25, respectively, are fitted in the inner wall of the pipe section. These form seals against the outer face of the plug.

It has been found that by using glass plugs 12 (i.e. ceramic plugs), the right-angled shoulder shape of the seat 18 results in the plug being exposed to unnecessary high strains. Consequently, frequent scratches and fissures arise that can easily lead to the whole plug breaking up.

It has now been found that if the seat, and the corresponding underside of the plug, are made with an inclined face in relation to the longitudinal axis X of the pipe 10, the plug is more capable of withstanding high pressure and pressure pulses.

Figure 2:
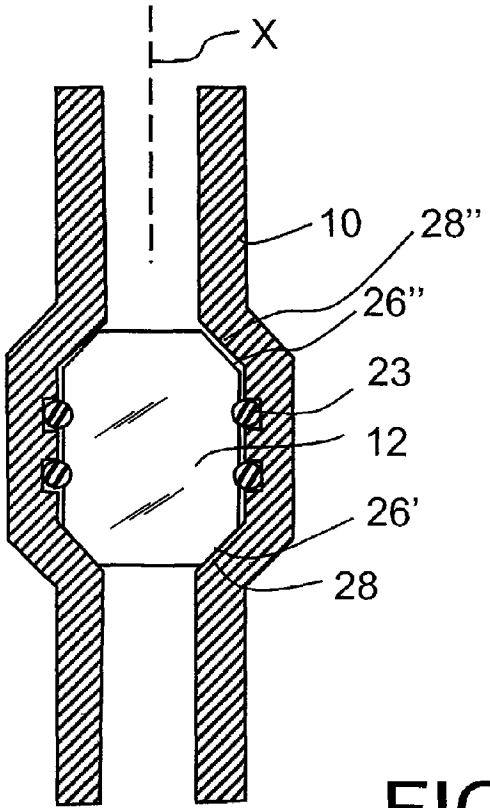
FIGS. 1 and 2 show a plug placed in a tubing/production pipe according to previously known solutions and the new solution according to the invention, respectively.

According to the present solutions, the contact seat, and the associated resting face of the plug, are therefore shaped as shown in FIG. 2, with the "sharp" edge 20 in FIG. 1 being replaced by an inclined ring face 26'. A corresponding ring-face 26" is formed in connection to the upper side of the plug. Inside the chamber 30, a correspondingly shaped lower seat 28 is formed in the inner wall of the pipe, upon which the plug 12 rests with its ring face 26'. Furthermore, the upper side of the plug is shaped with the corresponding inclined ring face 26" that fits an inclined face 28" in the upper part of the chamber 30. In the case shown, the faces 26',26"-28,28" form an angle of 45° with the pipe axis X. The face angle lies preferably between 30° and 60°.

The section that shall contain the removable plug must also be designed so that it does not prevent the subsequent operation of the production pipe. Furthermore, the plug section must not be too thick (diameter) because this can lead to the oil company having to use casing/lining pipes of correspondingly larger thickness. As the lining pipes can have lengths of 10 kilometers and more, a plug section which is too thick could lead to large extra costs for the production company. The aim of this part of the invention is based on the provision of a plug chamber with as large an inner diameter as possible, and with as small an outer diameter as possible.

Figure 4:
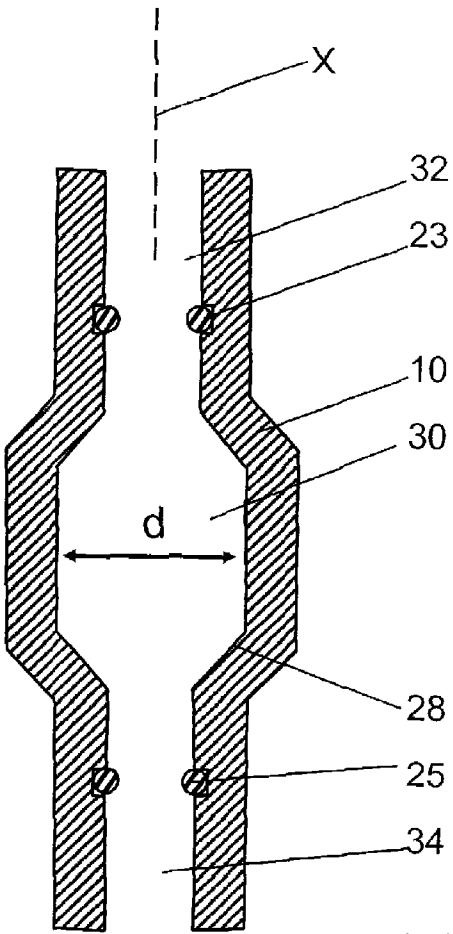
FIG. 4 shows a cross-section of the gasket section as it is shaped according to the new inventive solution.
Figure 3:
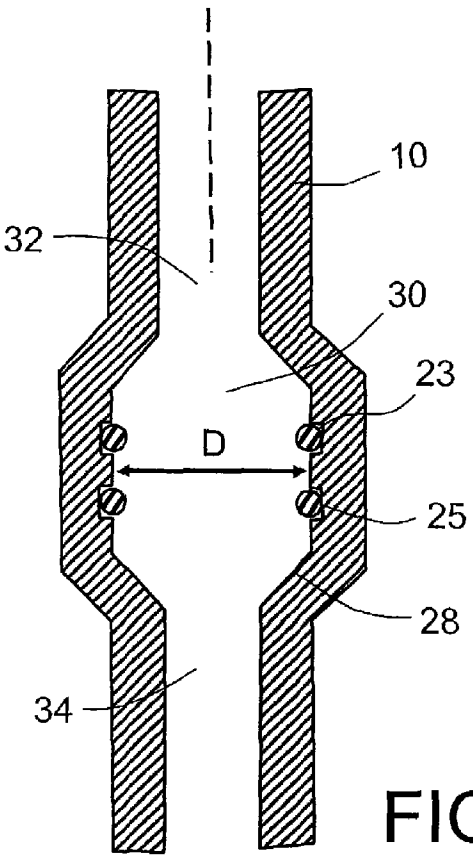
FIG. 3 Prior Art
FIG. 3 shows a cross-section of the gasket section as it normally is shaped in today's solution.

Therefore, it is an aim of the invention to provide a plug section with reduced thickness dimension (diameter). This is, as can be seen in FIG. 4, achieved in that the gasket constructions 23,25 in the inner wall, are removed from the plug chamber 30 itself to the cylindrical sections 32,34, respectively, which are lying just above and just below the chamber 30. With this method, which gives a reduced load on the glass plug, we can design more narrow contact faces without inflicting damage to the glass. Thus, the cross-section of the chamber 30 can be reduced from D shown in FIG. 3 to d shown in FIG. 4. With this solution, the hydraulic area is reduced by 30-50%, i.e. a correspondingly lower load at the same pressure.

The consequence of this new construction is that the plug section can be made more narrow, and thereby reduce the diameter requirement for lining pipes and production pipes.

Figure 5:
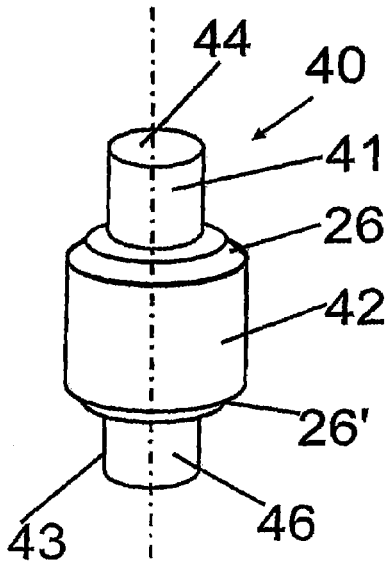
FIG. 5 shows a perspective diagram of the new plug construction for application in the gasket section according to FIG. 4.

The new plug construction according to the invention which is adapted to the gasket placing according to FIG. 4, is shown in FIG. 5 by 40. The plug 40 is shaped as a relatively extended cylinder, and with a middle plug section 42 with a larger diameter than the upper 44 and lower 46 sections, respectively, see below. From the respective top/bottom faces of the plug section 42, a shorter cylindrical section 44 and 46, respectively, extends outwards, also described as a shaft. The peripheral cylinder faces 41,43 are arranged to set up the necessary seal with the gaskets (O-rings) 23,25.

Experiments carried out have shown that by using this glass plug with the mentioned shafts 44,46, and where the seal occurs outside the chamber 30 itself, the hydraulic load is reduced by 35-50%, something which is very important, and can indeed be absolutely decisive for HPHT wells. HPHT denotes High Pressure-High Temperature.

Figure 6A:
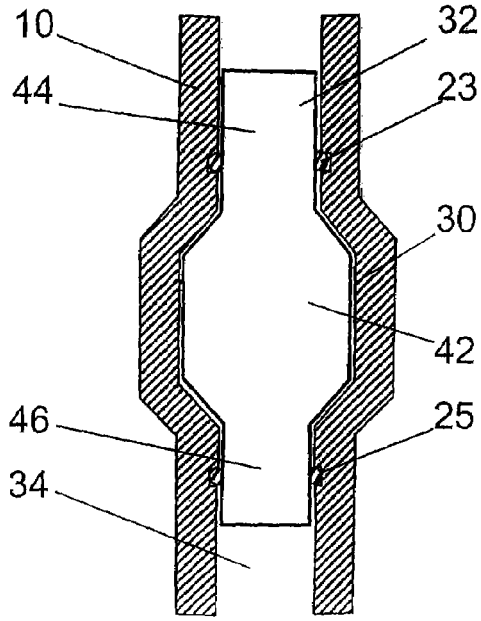
FIG. 6A shows a schematic cross-section of a plug according to FIG. 5 inserted in the pipe.

FIG. 6A shows schematically a cross-section of the mentioned plug according to FIG. 5, and which is inserted into the pipe 10.

Figure 6B:
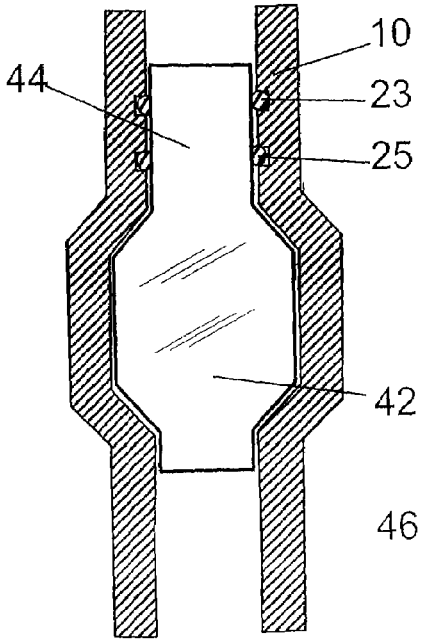
FIGS. 6B and 6C show schematic cross-sections of a plug with an upwardly extending cylindrical part and a downwardly extending cylindrical part, respectively.
Figure 6C:
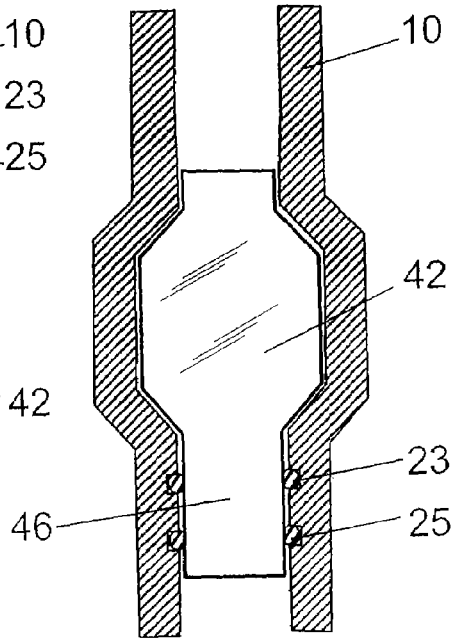

FIG. 6B shows schematically a cross-section of the solution where the cylindrical extension 44 protruding upwards from the plug body 42 itself, while FIG. 6C shows the solution with the extension 46 protruding downwards from the body 42.

It will appear from the above that the plug 42 is arranged to withstand pressure loads through the pipe from both sides of the plug, i.e. both the fluid pressure from above and existing pressure from fluids (oil/gas) from the formation, i.e. that act against the underside of the plug.

Removal of Plug by Explosion.

To place explosives inside a glass plug is known. When these are detonated, the plug is broken up into smaller pieces that can simply be flushed out of the well without leaving any residues that can be harmful. Tests show still that the plug gets weaker and malfunctioning can easily arise.

This is solved according to the invention in that a detonation section, in which one or more explosive charges are placed, is arranged in connection with the plug. Such a section can, for example, be built into the upper section 44 (or also the lower section 46) which is shown in FIG. 5.

Figure 7:
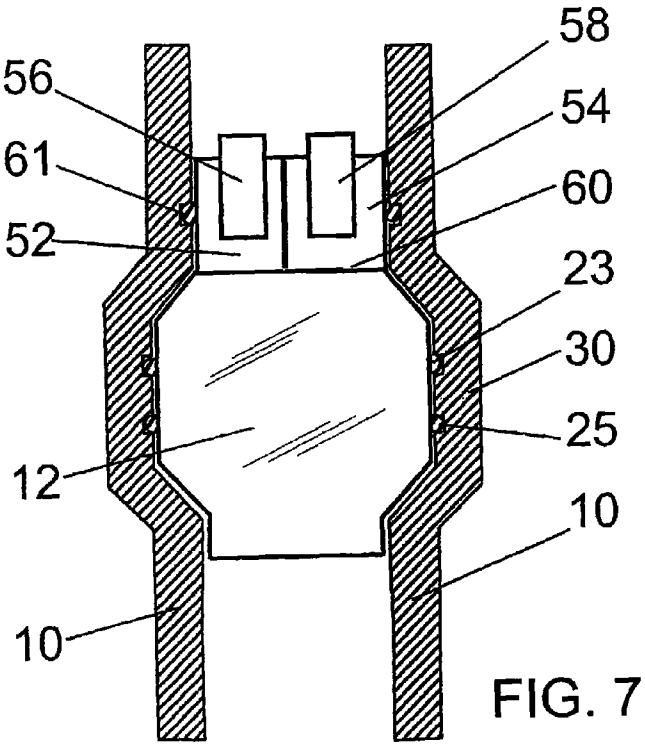
FIG. 7 shows a plug with the new detonating construction according to the invention.

An example of this solution is shown in FIG. 7. The figure shows the plug 12 (c.f. FIG. 2) placed in the sealing chamber 30 with gaskets 23,25. Arranged on the upper side of the plug is a detonation section 5 that can be formed to be a part of the glass plug 12 itself, or comprise an independent section that is fused with the glass plug 12 in a suitable way. A solution is indicated in the figure where the section 50 comprises two sub-sections 52,54. In these sub-sections, which can also be made of glass, the explosive charges 56,58 themselves are placed. The explosive charge can be brought to detonate in a known way by a fluid pressure influence, or by electrical ignition, or by other known methods.

The most important with this embodiment is that one gets a safer and simpler treatment of the plug with the explosives.

Furthermore, the plug without holes retains its original pressure strength when it does not comprise any hollow spaces for the explosives.

Operating safety is also a factor in the choice of this solution. In one plug it can be difficult to have more than one hole, because with several holes/hollows the plug strength is reduced considerably.

However, with the use of the sub-section as shown in FIG. 7, this can be pressure-relieved and not get any problems or weaknesses at high pressure.

The advantage with having a two-piece detonation section is that one retains the detonation function even if one of the charges is damaged or the glass breaks in the section.

The detonation section, which can be a separately cast unit, can be connected with (locked down on) the top 60 of the glass plug 12 with a simple locking mechanism, for example an O-ring. This O-ring, shown by 61, is fastened to the inner wall of the pipe 10 just above the plug top 60 and contributes to keep the detonation section in place. But the O-ring has no sealing function.

Gasket System.

As mentioned above, it is known that standard O-rings can damage the plug glass under extreme pressures so that scratches and micro-fissures can arise. Furthermore, too high surface pressure from the O-ring against the glass can easily arise.

Therefore, it is desirable to obtain a better pressure distribution on the glass.

According to the invention, a new solution is provided for the gasket system, said system will fulfil the above mentioned aim.

Figure 8:
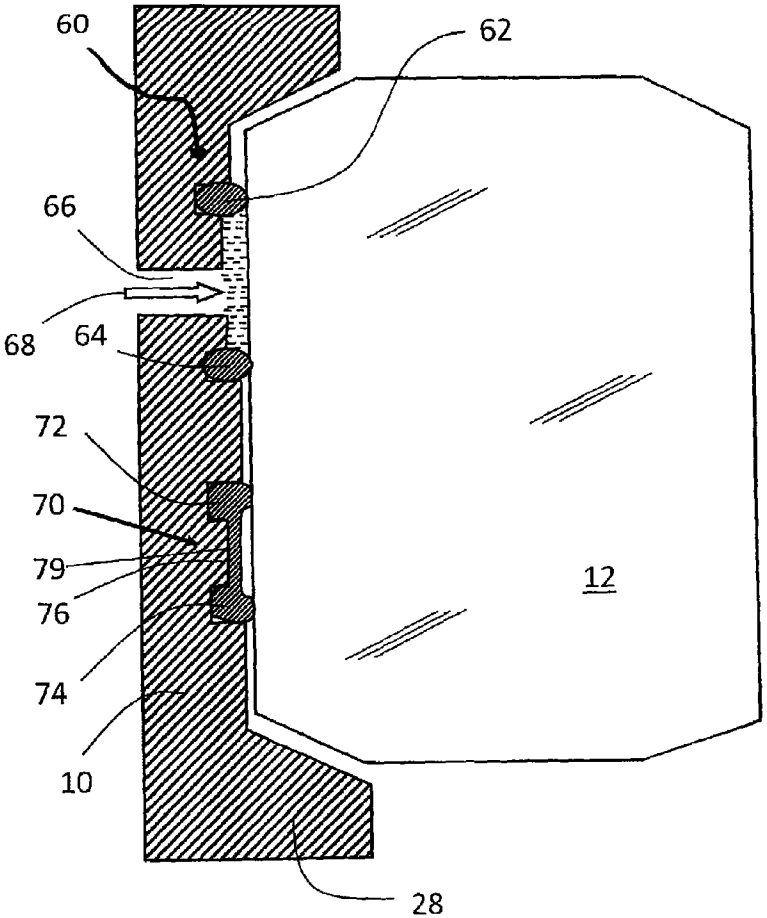
FIG. 8 shows a schematic cross-section of two variants of a gasket system that can be applied according to the invention to the plug construction.

Two new sealing constructions that will fulfil this aim are shown in FIG. 8. The figure shows a partial cross-section of a glass plug 12 that is placed in its seat in 28 in the pipe 10.

The two gasket versions are marked with the reference numbers 60 and 70 respectively.

Version 1: Upper 62 and lower 64 O-ring gaskets are arranged in the peripheral inner wall, i.e. in associated cut outs in the pipe wall. The distance between the gaskets 62,64 is designated a in FIG. 8. A peripheral ring-formed groove 66 is made between the cut outs in the inner wall of the pipe. Firstly, the glass plug is put in place in the chamber 30 and the gaskets 62,64 are positioned. A viscous liquid is thereafter injected from a source not further shown through the holes 68 in the groove, which is then filled all round the circle with the viscous liquid. The viscous liquid can, for example, be silicone grease. After the viscous liquid is injected in, one closes the holes 68 through the pipe wall by soldering, or the like, so that the liquid is isolated in the cut out.

The liquid will now contribute to distribute the pressure over a larger part of the side face of the glass plug. When the O-ring 62 makes a seal, the pressure will be distributed or propagated down into the viscous liquid and subsequently exert a load on the lower (second) O-ring 64. In this way, the surface pressure (pressure per unit area) against the glass will be substantially lowered and such that the danger of fissure formation and the like is reduced.

Version 2: According to another variant, which can also be seen in FIG. 8, the whole sealing system 70 is made of rubber. The starting point can still be upper and lower O-rings, shown as 72 and 74 in the figure and a groove 76 which is cut into the inner wall of the pipe 10. Instead of one or two individual O-rings in rubber, a rubber band 79 is used between the O-rings, with the band 79 shaped with the O-rings 72,74 themselves.

This solution contributes in the same way also to distribute the pressure so that the surface pressure against the glass is reduced, and the risk of fissure formations and operating failure are reduced.

More exactly, this can be used with the help of a method for distribution of pressure in connection with a ring-formed main sealing system that seals the gap between a sealing plug and an inner wall of a pipe, where several sealing rings, mutually spaced apart, are used. Thus, the first and second sealing rings are used, mutually spaced apart, and the pressure is distributed between the first sealing ring and one or more sealing rings by way of an intermediate material that connects the one or more sealing rings. As intermediate material a viscous liquid can be used such as a gel or it can be of the same material as the sealing rings and shaped as an integral part of these.

The used glass plug according to the invention operates such that it seals the passage through the production pipe in its entirety. Thus, it is possible to carry out a test of the pipe. With such a test, one pressurises the space above the plug. If the space can retain the pressure, it is assumed that it is leak-proof, i.e. no leaks will occur.

To activate and destroy the plug, this is carried out with the use of explosives and a pressure-controlled detonator, c.f. as is described in the text of FIG. 7.

With the present invention one has gained great advantages in:

1. That the glass plug is equipped with a type of shaft with about the same outer diameter as the inner diameter of the "housing" and that the seals are placed on this outer face.
2. That the seals are built with combinations where more than one O-ring is used coupled in series to lower the surface pressure against the glass.
3. That the explosives or other mechanisms for removal of the plug are placed in their own unit that stands outside the glass plug and does not alter the pressure rating of the plug.

The invention claimed is:

1. An arrangement of a plug with a sealing system for pressure testing of bore holes in a formation, comprising:

a plug having a main plug body including opposite ends and a side, wherein cylindrical extensions respectively extend from opposite ends of the plug body, wherein the plug includes an underside resting face extending from the plug body side to one of the cylindrical extensions;

a pipe having a plug-carrying chamber in which the plug is fitted, wherein the chamber is formed with a seat, wherein the underside resting face of the plug rests against the seat; and sealing bodies, wherein the plug seals the passage through the pipe in cooperation with the sealing bodies, as the plug rests in the seat in the chamber, wherein at least one of the sealing bodies is arranged in connection with an inner wall of the pipe so as to be positioned one of above and below the chamber, and is arranged to make a seal against one of the cylindrical extensions of the plug body extending above or below the chamber.

2. The arrangement according to claim 1, wherein each sealing body comprises an O-ring which is fitted in ring-shaped cut outs in the inner wall of the pipe.

3. The arrangement according to claim 1, wherein the main plug body is cylindrical, wherein at least one of the cylindrical extensions has a smaller diameter than the main body and protrudes with a given distance above or below the end of the main body, wherein the underside resting face extends between the side of the cylindrical main plug body and the smaller diameter cylindrical extension.

4. The arrangement according to claim 3, wherein the underside resting face of the plug that rests against the seat forms an angle in the area 10-80° with respect to the longitudinal axis of the plug.

5. The arrangement according to claim 4, wherein at least one of the cylindrical extensions integrated with the main plug body itself.

6. The arrangement according to claim 1, wherein the sealing bodies are arranged in connection with the inner wall of the pipe so as to be positioned above and below the chamber, respectively, wherein peripheral ring-shaped surfaces of the cylindrical extensions form the seals with the respective sealing bodies in connection to the pipe.

7. The arrangement according to claim 1, wherein the underside resting face of the plug is inclined at an angle with respect to the longitudinal axis of the plug, wherein the seat in the chamber is inclined at the same angle as the underside resting face.

8. The arrangement according to claim 1, wherein the plug is arranged to be disintegrated by crushing by detonation of an explosive charge, wherein the explosive charge is arranged in a detonation section connected to the plug, said section is arranged to lie outside the chamber.

9. The arrangement according to claim 8, wherein the detonation section is divided into two sub-sections, each containing an explosive charge.

10. The arrangement according to claim 8, wherein the detonation section and the plug are made of glass, wherein the detonation section is merged with the glass plug.

11. The arrangement according to claim 8, wherein the detonation section is separated from the glass plug and positioned adjoining the plug surface, wherein an O-ring is disposed between the inner wall of the pipe and the detonation section so as to hold the detonation section in position.

12. The arrangement according to claim 1, wherein the sealing bodies comprise first and second ring gaskets arranged mutually spaced apart in the pipe wall, wherein each of the first and second ring gaskets are fitted in a cut out that is cut into the pipe wall, and wherein a ring-formed cut out, which is arranged to contain a viscous fluid, is made in the pipe wall between the ring gaskets, such that when the plug is fitted in the chamber the two ring gaskets and the intermediate viscous fluid form a sealing effect together against the side of the plug.

13. The arrangement according to claim 12, wherein after the plug is fitted, fluid is fed into the cut out through one or more openings in the pipe wall, said one or more openings being thereafter closed.

14. The arrangement according to claim 13, wherein an intermediate material in the form of a viscous liquid, such as a gel, is used.

15. The arrangement according to claim 1, wherein the sealing bodies comprise first and second sealing rings arranged mutually spaced apart in the pipe wall and a band-formed sealing body disposed therebetween, wherein each of the first and second sealing rings are each fitted in a cut out that is cut into the pipe wall, and wherein the band-formed sealing body is fitted in another cut out that is cut into the pipe wall between the first and second sealing rings.

16. The arrangement according to claim 15, wherein the band-formed sealing body is integrated with the first and second sealing rings.

* * * * *

UNITED STATES PATENT AND TRADEMARK OFFICE

CERTIFICATE OF CORRECTION

PATENT NO. : 7,624,796 B2
APPLICATION NO. : 10/545667
DATED : December 1, 2009
INVENTOR(S) : Tore Hassel-Sorensen It is certified that error appears in the above-identified patent and that said Letters Patent is hereby corrected as shown below:

In claim 5, column 6, line 53, reading "one of the cylindrical extensions integrated with the main" should read --one of the cylindrical extensions is integrated with the main--.

In claim 6, column 6, line 59, reading "the cylindrical extensions form the seals with the respective" should read --the cylindrical extensions form seals with the respective--.

Signed and Sealed this

Twenty-third Day of March, 2010

David J. Kappos

David J. Kappos
*Director of the United States Patent and Trademark Office*